US008754311B2

(12) United States Patent
Belmondo et al.

(10) Patent No.: US 8,754,311 B2
(45) Date of Patent: Jun. 17, 2014

(54) SOUND CHESTS FOR HARPS AND METHODS FOR MANUFACTURING SAME

(75) Inventors: Armando Belmondo, Turin (IT); Giorgio Peirano, Saluzzo (IT)

(73) Assignee: N.S.M. S.p.A., Piasco (CN) (IT)

( * ) Notice: Subject to any disclaimer, the term of this patent is extended or adjusted under 35 U.S.C. 154(b) by 0 days.

(21) Appl. No.: 13/702,084

(22) PCT Filed: Jun. 15, 2011

(86) PCT No.: PCT/IB2011/052588

§ 371 (c)(1),
(2), (4) Date: Dec. 5, 2012

(87) PCT Pub. No.: WO2011/158186

PCT Pub. Date: Dec. 22, 2011

(65) Prior Publication Data

US 2013/0074673 A1 Mar. 28, 2013

(30) Foreign Application Priority Data

Jun. 15, 2010 (IT) ..... TO2010A0510

(51) Int. Cl.

| | |
|---|---|
| ***G10D 1/04*** | (2006.01) |
| ***G10D 1/08*** | (2006.01) |
| ***G10D 3/00*** | (2006.01) |

(52) U.S. Cl.
USPC ..... 84/265; 84/264; 84/267; 84/291

(58) Field of Classification Search
USPC ..... 84/265, 264, 291
See application file for complete search history.

(56) References Cited

U.S. PATENT DOCUMENTS

| | | | | | |
|---|---|---|---|---|---|
| 437,918 | A | * | 10/1890 | Durkee | 84/265 |
| 538,038 | A | * | 4/1895 | Durkee | 84/265 |
| 744,105 | A | * | 11/1903 | Rath | 84/265 |
| 1,167,504 | A | * | 1/1916 | Kirk | 84/265 |
| 1,501,907 | A | * | 7/1924 | Kirk | 84/264 |
| 1,817,951 | A | * | 8/1931 | Starke | 84/264 |
| 3,051,033 | A | * | 8/1962 | Pratt | 84/265 |
| 4,796,504 | A | * | 1/1989 | McWillis | 84/265 |
| 4,919,024 | A | * | 4/1990 | Budin | 84/265 |
| 5,469,770 | A | * | 11/1995 | Taylor | 84/291 |
| 5,900,561 | A | | 5/1999 | Wechter | |

(Continued)

FOREIGN PATENT DOCUMENTS

AU 588867 B2 10/1986

OTHER PUBLICATIONS

Chris Waltham, Andrzej Kotlicki, Vibrational Characteristics of Harp Soundboards, Apr. 16, 2008.

*Primary Examiner* — David Warren
*Assistant Examiner* — Christina Russell
(74) *Attorney, Agent, or Firm* — Robert E. Alderson, Jr.

(57) ABSTRACT

Sound chests having a sound board connected to a hollow body which includes a bearing structure to which there is connected an outer shell are provided. In such sound chests the bearing structure includes a bottom wall or chest-bottom, and a top member or upper block, a central longitudinal batten or backboard, and two side battens or planks, which extend between the chest-bottom and the upper block, remote from and close to the sound board, respectively; and a plurality of longitudinally staggered, transverse stiffening members or bridges each of which is connected centrally to the backboard with its ends connected to the side planks. Methods for making such sound chests are also provided.

8 Claims, 7 Drawing Sheets

(56) References Cited

U.S. PATENT DOCUMENTS

| | | | | |
|---|---|---|---|---|
| 7,268,280 | B2 * | 9/2007 | McPherson | 84/290 |
| 7,498,495 | B1 * | 3/2009 | Mooers | 84/265 |
| 7,534,954 | B1 * | 5/2009 | Cassista | 84/731 |
| 7,790,970 | B2 * | 9/2010 | McPherson | 84/291 |
| 7,939,735 | B2 * | 5/2011 | Ahn et al. | 84/265 |
| 2004/0060417 | A1 | 4/2004 | Janes | |
| 2013/0074672 | A1 * | 3/2013 | Belmondo et al. | 84/265 |

* cited by examiner

SOUND CHESTS FOR HARPS AND METHODS FOR MANUFACTURING SAME

CROSS-REFERENCE TO RELATED APPLICATIONS

This application is a National Phase Application of PCT International Application No. PCT/IB2011/052588, International Filing Date, Jun. 15, 2011, claiming priority to Italian Patent Application No. TO2010A000510, filed Jun. 15, 2010, both of which are hereby incorporated by reference in their entirety.

FIELD OF THE INVENTION

The present invention relates in general to harps, and in particular to sound chests for harps.

More specifically, the invention relates to a sound chest of the type comprising a sound board connected to a hollow body which includes a bearing structure to which there is connected an outer shell having approximately the shape of half a truncated cone, and wherein the bearing structure comprises

- a bottom wall or chest-bottom, and a top member or upper block,
- a central longitudinal batten or backboard, and two side battens or planks, which extend between the chest-bottom and the upper block, and
- a plurality of longitudinally staggered, transverse stiffening members or bridges each of which is connected centrally to the backboard and has its ends connected to the side planks; and wherein
- the outer shell is connected to the surfaces of said battens which face towards the outside.

BACKGROUND OF THE INVENTION

A harp is a chordophone instrument provided in general with 47 strings, for most of which it is possible to carry out the sharp and flat changes by operating pedals or special levers.

Concert harps are usually manufactured using traditional methods, resorting primarily to the use of wood. The criteria for the design and manufacture are defined in a rather empirical way, and therefore the features of the manufactured instruments often suffer from poor reproducibility and reliability.

The "heart" of a harp is represented by the sound chest: this chest is in effect the main bearing structure, and constitutes the source of the vibroacoustics and timbre of the instrument.

The main parts of the sound chest of a harp are the sound board and the associated hollow body or shell, which operate together with each other but with respective different roles.

The sound board primarily has to accomplish two seemingly antithetic tasks: on the one hand, it has to accomplish a structural function for providing stable and secure opposition to the pull applied by the strings, and on the other hand it has to have high elasticity for effective transformation of the vibration of the strings into sound output.

The hollow body or shell of the sound chest comprises a bearing structure, the main elements of which are represented by the battens (backboard and two side planks), which extend between the chest-bottom and the upper block. This structure is transversely stiffened by a plurality of (generally four) longitudinally staggered, transverse members or bridges.

A closing shell manufactured typically with a multi-ply sheet of maple wood is applied to this bearing structure with a thickness of about 5 mm. This shell is bent and glued to the chest-bottom, to the upper block, to the side planks and to the backboard by a vacuum press, with an associated heating system which can make the bonding sufficiently quick.

During operation, the bent multi-ply shell is subjected to stresses which tend to cause it to deform inwards in an implosive manner (so-called "buckling"), which is extremely undesirable. Indeed, this deformation not only changes the shape of the chest in an aesthetically unappealing manner, but is also structurally unsuitable, since it makes the chest system excessively elastic, creating serious problems in terms of the stability of the sound board and the tuning In order to limit these phenomena and increase the rigidity of the shell without increasing the weight excessively, the prior art provides for encircling transverse members or small bands to be glued to the internal surface of the shell, intended to limit the deformation of the bent multi-ply wood with which the shell is formed.

In order to further increase the bending strength of the shell, the shape thereof essentially as half a truncated cone is "swelled up" like a barrel, with a rather marked bending camber by the backboard and the side planks. This "swelling up" like a barrel creates considerable problems in manufacture, in particular in the step for bending the multi-ply maple wood with which the shell is formed: it is possible indeed for there to be instances of internal strain created in the plies, likely to produce delamination and also "voids", while considerable folds or wrinkles can form on the external surface of the shell on account of compression of the outer plies. The elimination of these design defects requires an important step for manually finishing the external surface of the shell, by scraping and sanding, in order to make the shell aesthetically acceptable and return the shape to the established dimensions.

Depending on the nature and the extent of the defects created during the moulding of the shell, the external finishing involves the removal of plies of differing thickness, and therefore the finished shell does not have a constant thickness in all the parts thereof. This alters the overall rigidity profile of the shell and produces a dispersion in the characteristics of the bending behaviour of the chest, as well as between one chest and another.

As regards the bearing structure of the sound chest, the prior art provides for the connection between the bridges, the backboard and the internal planks to be realized by the juxtaposition of the planar faces thereof, between which an adhesive is interposed. This way of implementing the connections is unsatisfactory, since the various components are assembled in temporally successive stages, with manual repair interventions which cause dispersions in the characteristics of the manufactured product.

SUMMARY OF THE INVENTION

It is an object of the present invention to propose an improved sound chest for a harp which can make it possible to eliminate or at least significantly reduce the above-outlined disadvantages of the chests according to the prior art.

It is a further object of the invention to propose an improved method for assembling such a sound chest.

These and other objects are achieved according to the invention by a sound chest of the type defined in the introduction, which is characterized in that said bridges are at least partially glued to the internal surface of the shell of the chest.

According to a further feature, the mutual engagement portions of the bridges and the battens have substantially complementary transverse profiles, at least partially interpenetrated with each other.

On account of these features, the bearing structure of the sound chest has greater bending and rotational rigidity. As a result, the structural stability of the chest is increased, and this makes it possible to eliminate the small transverse bands glued to date to the internal surface of the shell.

On account of the adoption of complementary profiles for mutual engagement between the bridges and the battens, and of the interpenetration thereof, the joints between these components are substantially insertion joints, with a resulting maximization of the structural stability of the assembly as a whole.

The increased stability of the bearing structure makes it possible to reduce the thickness of the shell, which facilitates the formability and increases the vibrational contribution, with an advantageous impact on the timbre of the instrument's sound.

The mutual engagement portions of the battens and the bridges are expediently connected with each other by means of an adhesive interposed between the interpenetrated complementary profiles thereof, and the bond is stabilized through interconnection members, such as screws or the like, which are inserted from the outer surface of the battens and which extend through the battens and are then inserted into the bridges.

According to a further feature, the surfaces of the battens which face towards the inside of the chest are flat.

In one embodiment, the portions of the bridges for mutual coupling with the side battens or planks have each a recessed seat with an essentially L-shaped transverse profile. The portions of the bridges for engagement with the central batten or backboard can expediently have a recessed seat having a transverse profile essentially like a squared channel.

The invention also proposes an innovative method for assembling a sound chest of a harp, comprising the steps of predisposing the transverse stiffening members or bridges, the central batten or backboard and the side battens or planks, assembling the components predisposed in the preceding step, to form the bearing structure of the sound chest, and fastening to said bearing structure an outer shell;

the method being characterized by predisposing a template including a block having a shape at least partially corresponding to the internal volume of the sound chest to be manufactured and having a plurality of transverse seats adapted to receive and position each a respective bridge and a plurality of longitudinal receptacles adapted to receive and position each a respective longitudinal batten;

the bridges being thereafter positioned in the respective seats, and the battens being thereafter inserted into the respective receptacles and coupled with and fastened to the bridges;

at least one flexible sheet being coupled to and fixed to the outer surface of the assembly formed by the template and the components positioned and assembled therein; and the thus loaded template is passed in a press, for example a heated vacuum press, for a predetermined time.

Further features and advantages of the invention will become apparent from the detailed description and reference to the appended drawings briefly described below.

DETAILED DESCRIPTION

Figure 1:
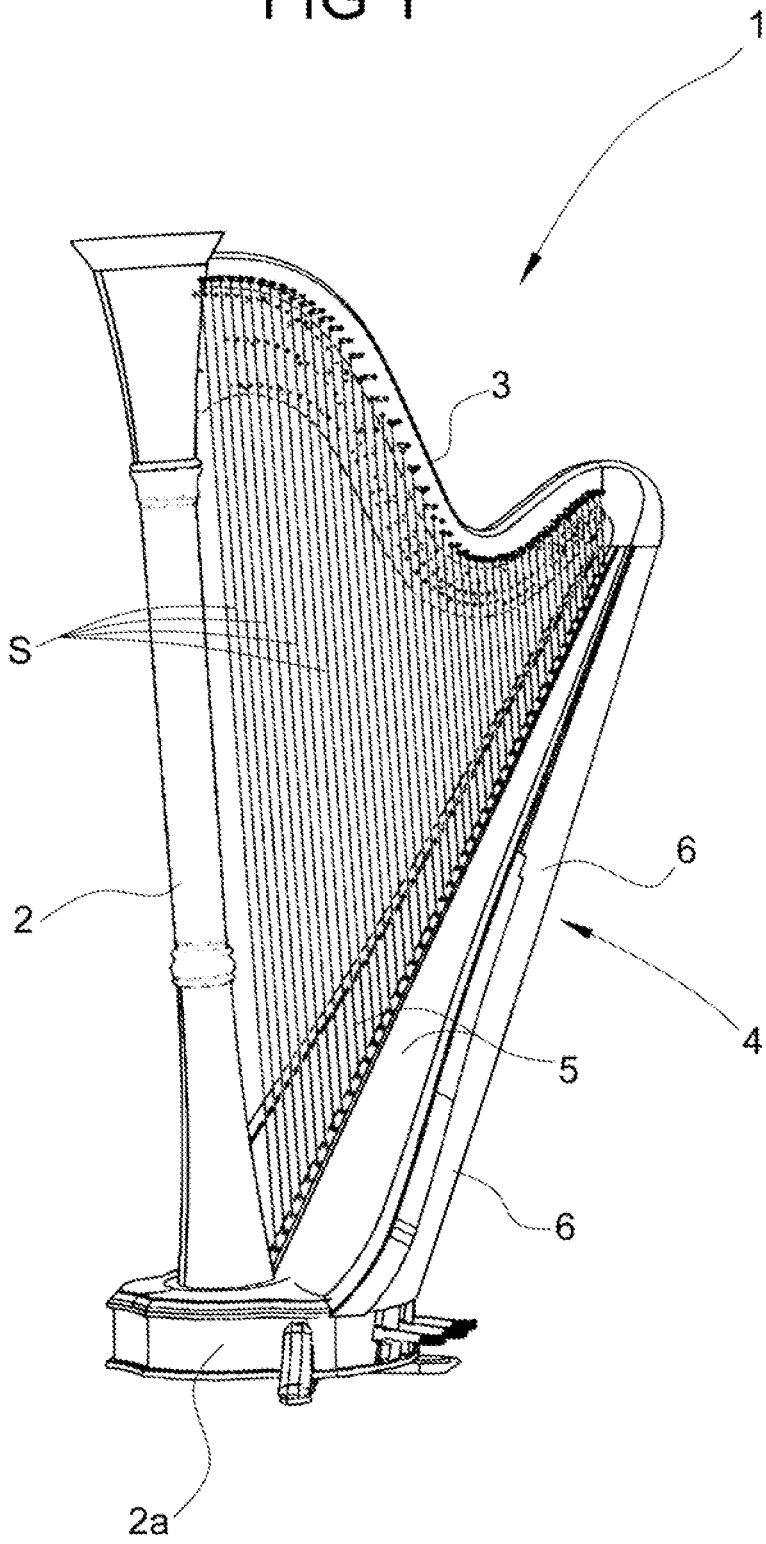
FIG. 1 is a perspective view of a concert harp.

In FIG. 1, a concert harp is designated as a whole by 1. In a manner known per se, this harp comprises an essentially vertical column 2, which extends upwards from a base 2*a*.

What is known as the neck 3 extends from the top portion of the column 2, and the distal end of said neck is joined to the top part of the sound chest, which is designated as a whole by 4.

The sound chest 4 comprises a sound board 5, the peripheral edge of which is bound robustly to a hollow body 6, which generally essentially is shaped like half a truncated cone.

The harp 1 comprises a plurality of strings S, one end of which is fastened to the neck 3 and the other end of which is anchored to the sound board 5.

Figure 2:
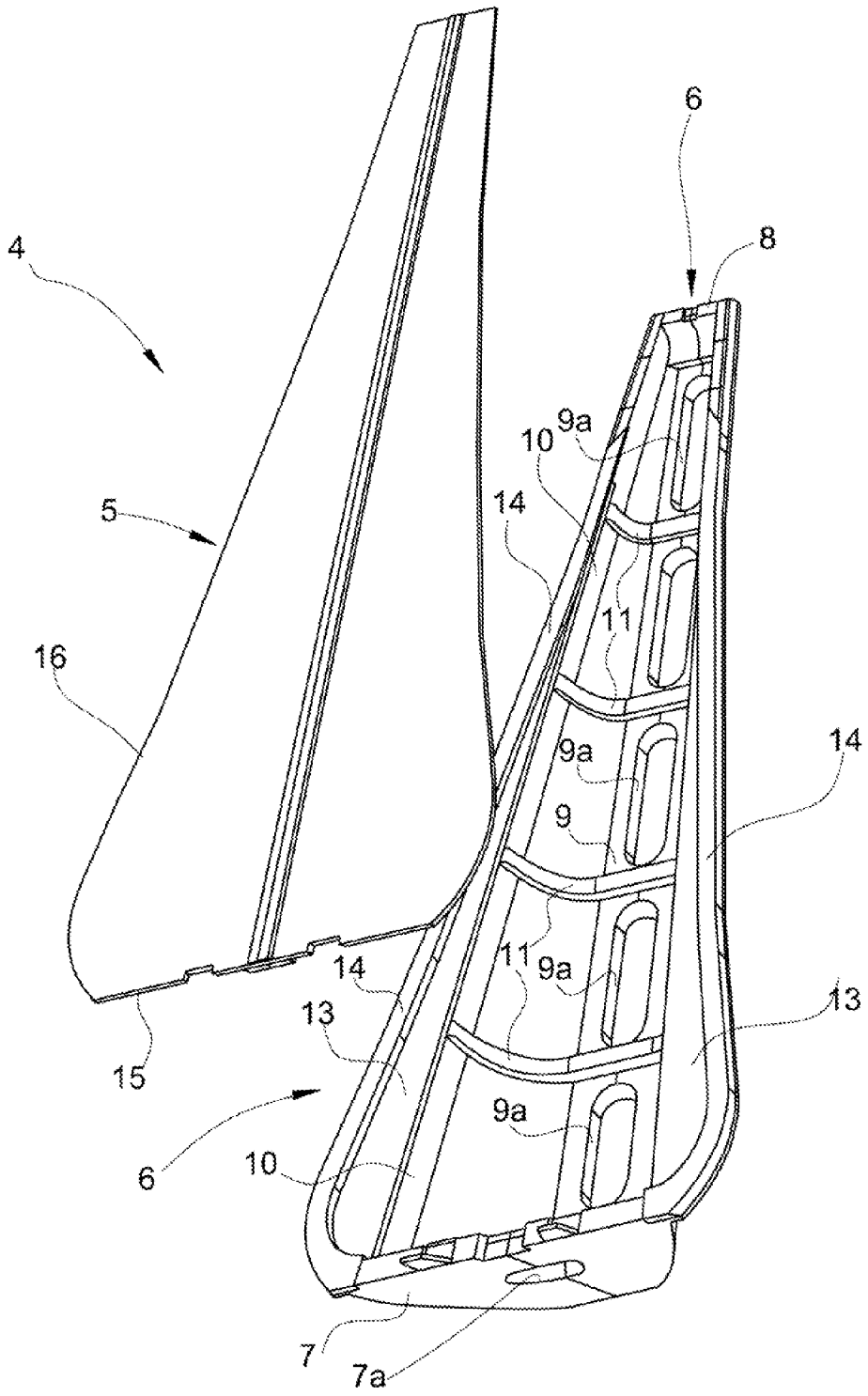
FIG. 2 is a partially exploded perspective view of a sound chest for a concert harp according to the present invention.
Figure 3:
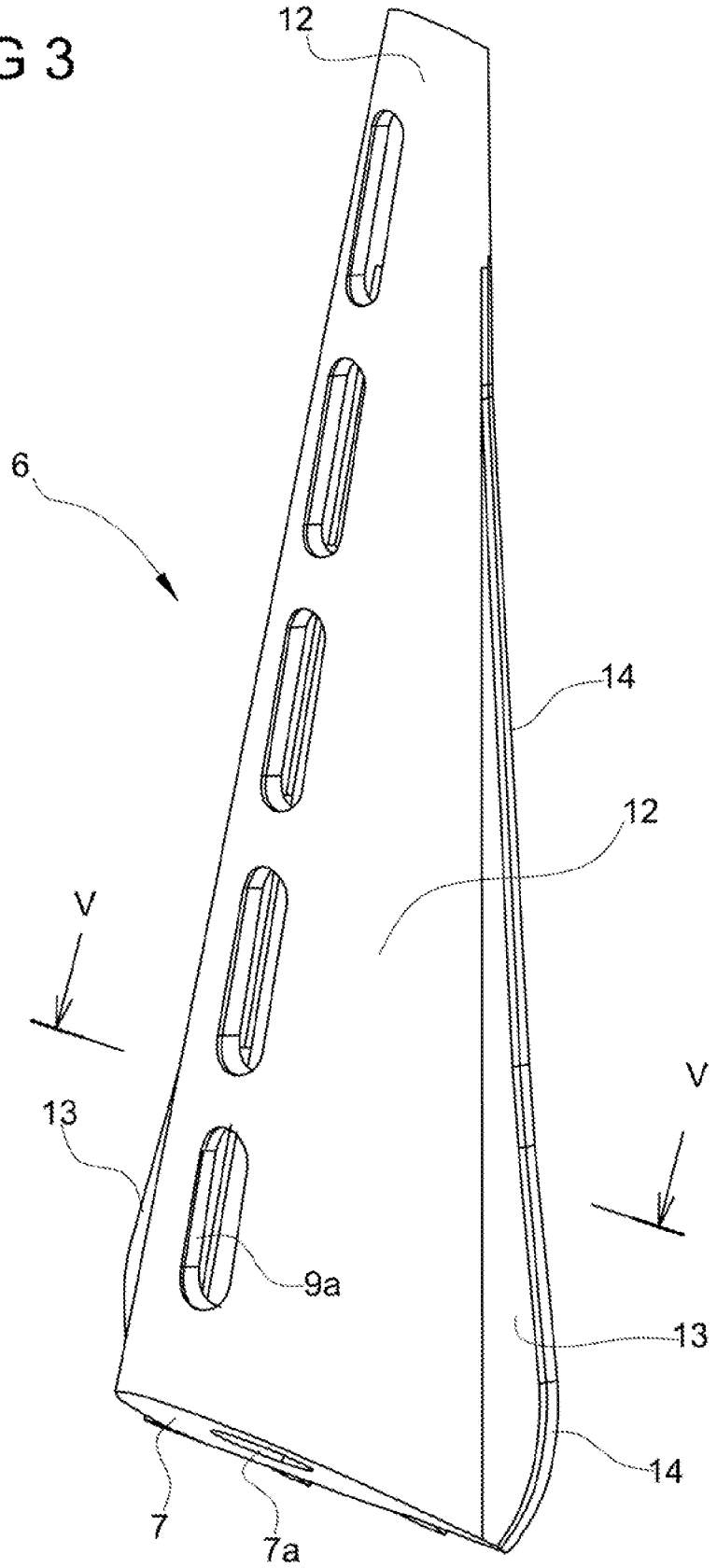
FIG. 3 is a perspective view from the rear of the sound chest shown in FIG. 2.
Figure 4:
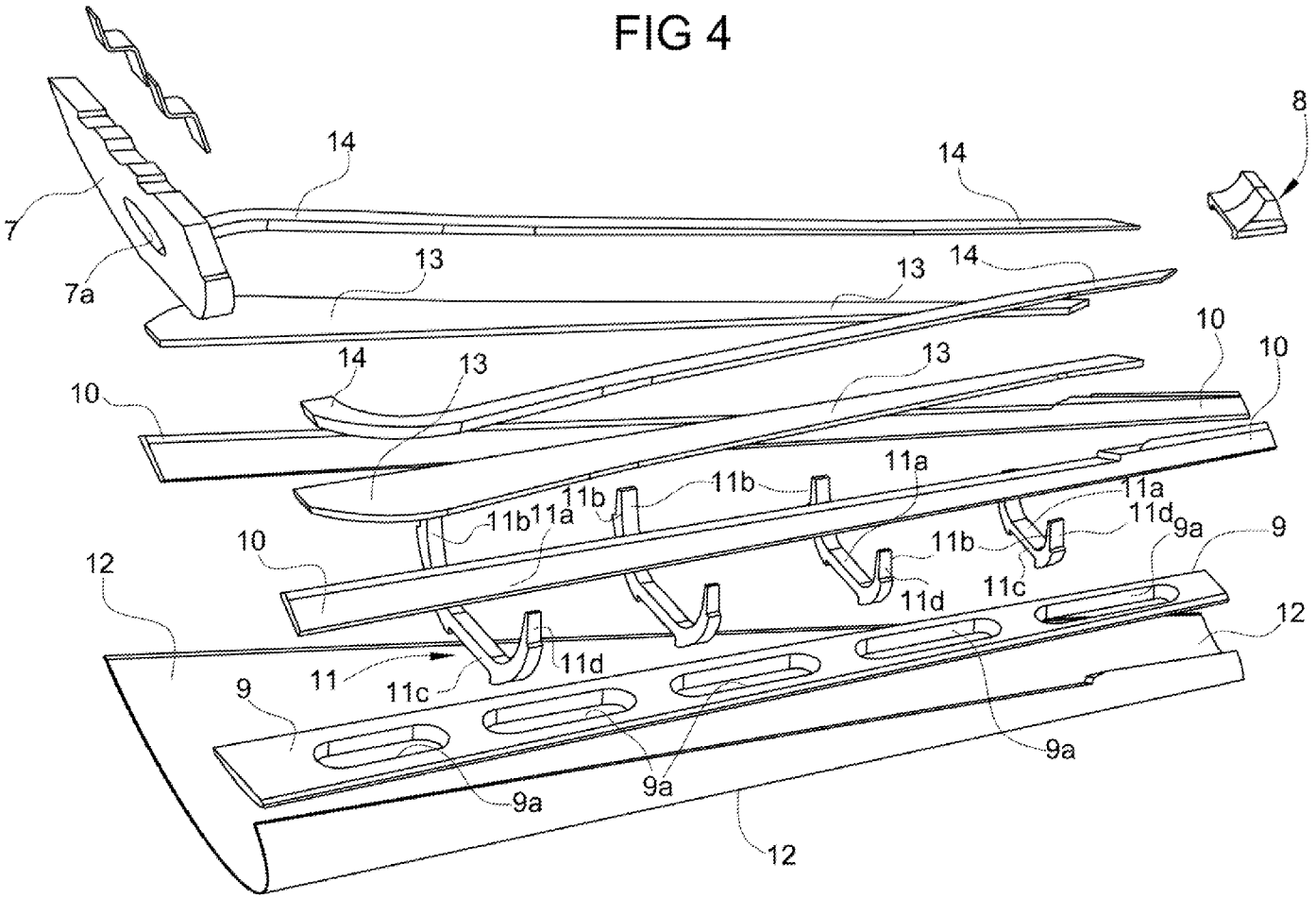
FIG. 4 is an exploded perspective view of the sound chest shown in the preceding figures.
Figure 5:
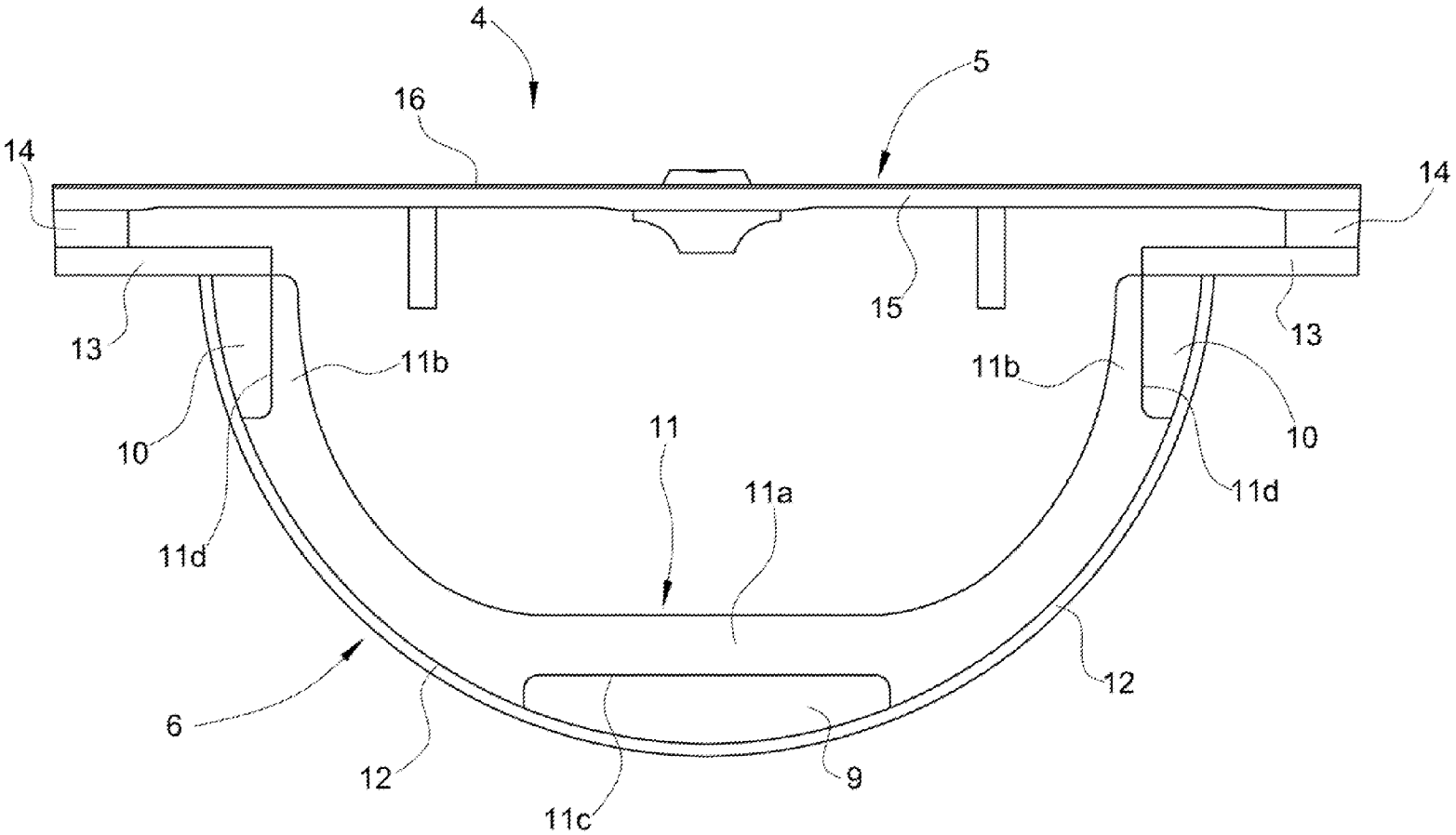
FIG. 5 is a sectional view substantially along line V-V in FIG. 3.

With reference in particular to FIGS. 2, 4 and 5, in the embodiment illustrated the hollow body 6 of the sound chest 4 has a bearing structure comprising a bottom part or chest-bottom 7, which is expediently provided with an opening 7*a*, and a top member or upper block 8; the latter has transverse dimensions which are reduced considerably with respect to those of the chest-bottom 7;

a central longitudinal batten or backboard 9, and two symmetrical side battens or planks 10 (see in particular FIG. 5); the battens 9 and 10 extend between the chest-bottom 7 and the upper block 8; and a plurality of longitudinally staggered, transverse stiffening members or bridges 11; each bridge 11 has an intermediate portion 11*a* connected to the central batten or backboard 9, and end portions 11*b* connected to the side battens or planks 10 (FIG. 5).

In the embodiment illustrated, the bearing structure comprises four bridges 11 and the central batten or backboard 9 has five corresponding openings 9*a* of elongate form, at the ends and between each pair of consecutive bridges 11.

An outer shell 12 is connected to the above-described bearing structure, having approximately the shape of half a truncated cone and formed for example with multi-ply maple wood which is bent and glued to the external surfaces of the backboard 9, of the side battens or planks 10 and of the bridges 11, as well as to the external surfaces of the chest-bottom 7 and of the upper block 8.

As has already been mentioned above, in the sound chest 4 according to the invention the battens 9, 10 and the bridges 11 have respective portions for mutual engagement, having substantially complementary transverse profiles, at least partially interpenetrated with each other.

With reference in particular to FIG. 5, a recessed seat 11*c* is predisposed for engagement with the central batten or backboard 9 in the intermediate portion 11*a* of each bridge 11, said recessed seat having a transverse profile shaped essentially as a squared channel, complementary to the transverse profile of this batten or backboard 9.

For engagement with the side battens or planks 10, the end portions 11*b* of the bridges 11 have each a recessed seat 11*d*, with an essentially L-shaped transverse profile, preferably with a rounded vertex, complementary to the transverse profile of said side battens or planks 10.

An adhesive is interposed between the recessed seats 11*c* and 11*d* of the bridges and the corresponding surfaces of the longitudinal battens 9 and 10.

The engagement between the battens 9, 10 and the bridges 11 is further strengthened and stabilized by interconnection members, in particular screws or the like, which are advantageously inserted from the outer surface of the battens 9, 10 and which extend through these battens 9, 10 and are then inserted into the bridges 11.

As can be seen in particular in FIG. 5, the transverse profiles of the external surfaces of the bridges 11 and of the battens 9, 10 are joined with each other continuously, so as to form a single arched profile in a uniform manner.

As has already been pointed out above, the surfaces of the battens 9, 10 which face towards the inside of the hollow body 6 are expediently flat. The external or outer surfaces thereof may expediently bulge, however, with a relatively contained maximum bending camber of about 2 mm, for example.

The sound board 5, in a manner known per se, has a transverse width which, in the direction of the chest-bottom 7, widens increasingly with respect to that of the shell 12.

The engagement between the peripheral edge of the sound board 5 and the shell 12, and also the relative bearing structure 9-11, is realized by a pair of symmetrical fins 13, for example of plywood, which are glued to the side planks or battens 10 and project outwards beyond the shell 12 (FIG. 5). The distal edges of the fins 13 are connected to the sound board 5 by splints or small bands 14, for example of fir, by adhesive bonding.

Expediently, in a manner known per se, the sound board 5 comprises a main board 15 and an outer ply of veneer 16 (FIGS. 2 and 5). The main board 15 is expediently glued to the fins 13 with the interposition of the splints 14.

The hollow body 6 can be manufactured using a more standardized and repeatable design process.

The various components of this hollow body can expediently be manufactured by means of a CNC work centre, which ensures that the manufactured products have a high reproducibility and quality.

Figure 6:
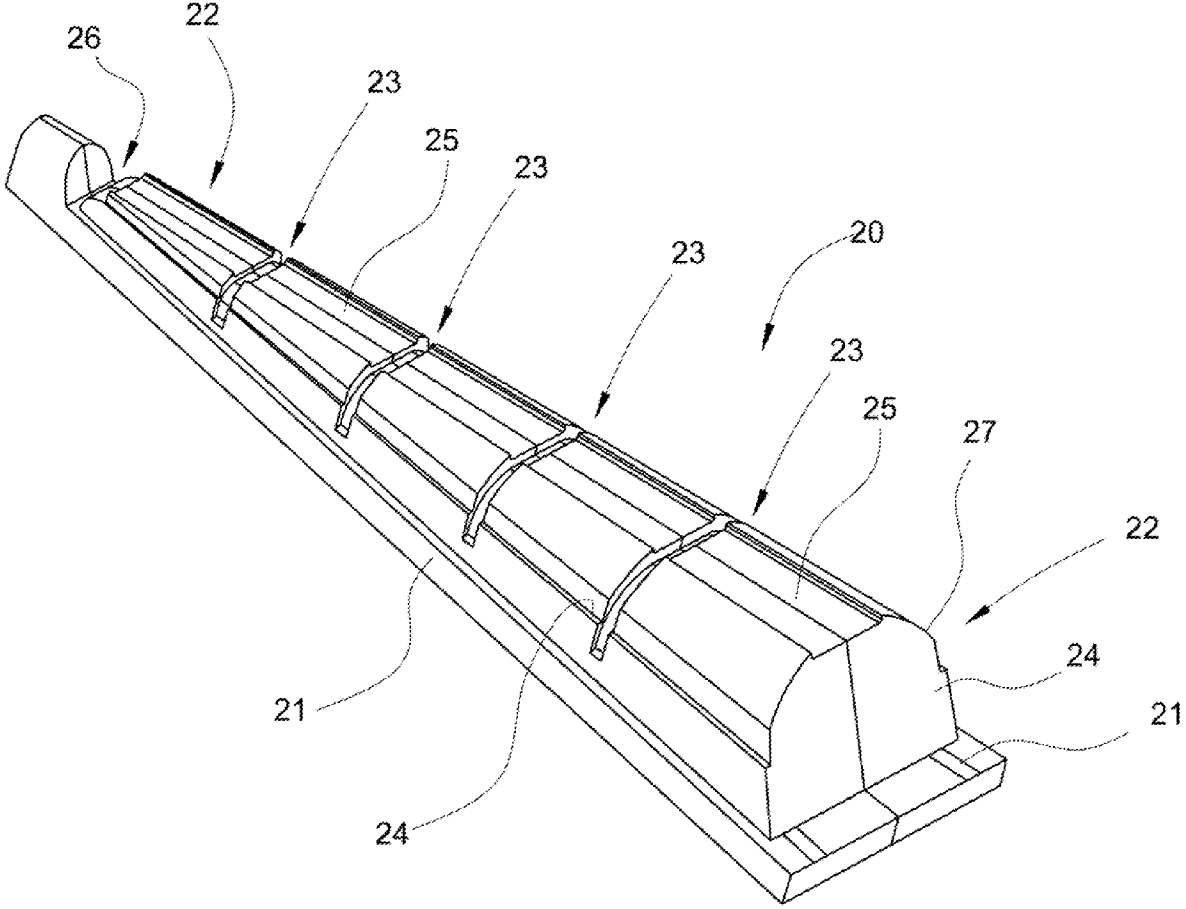
FIG. 6 is a perspective view of a template which can be used for the manufacture of a sound chest according to the invention.
Figure 7:
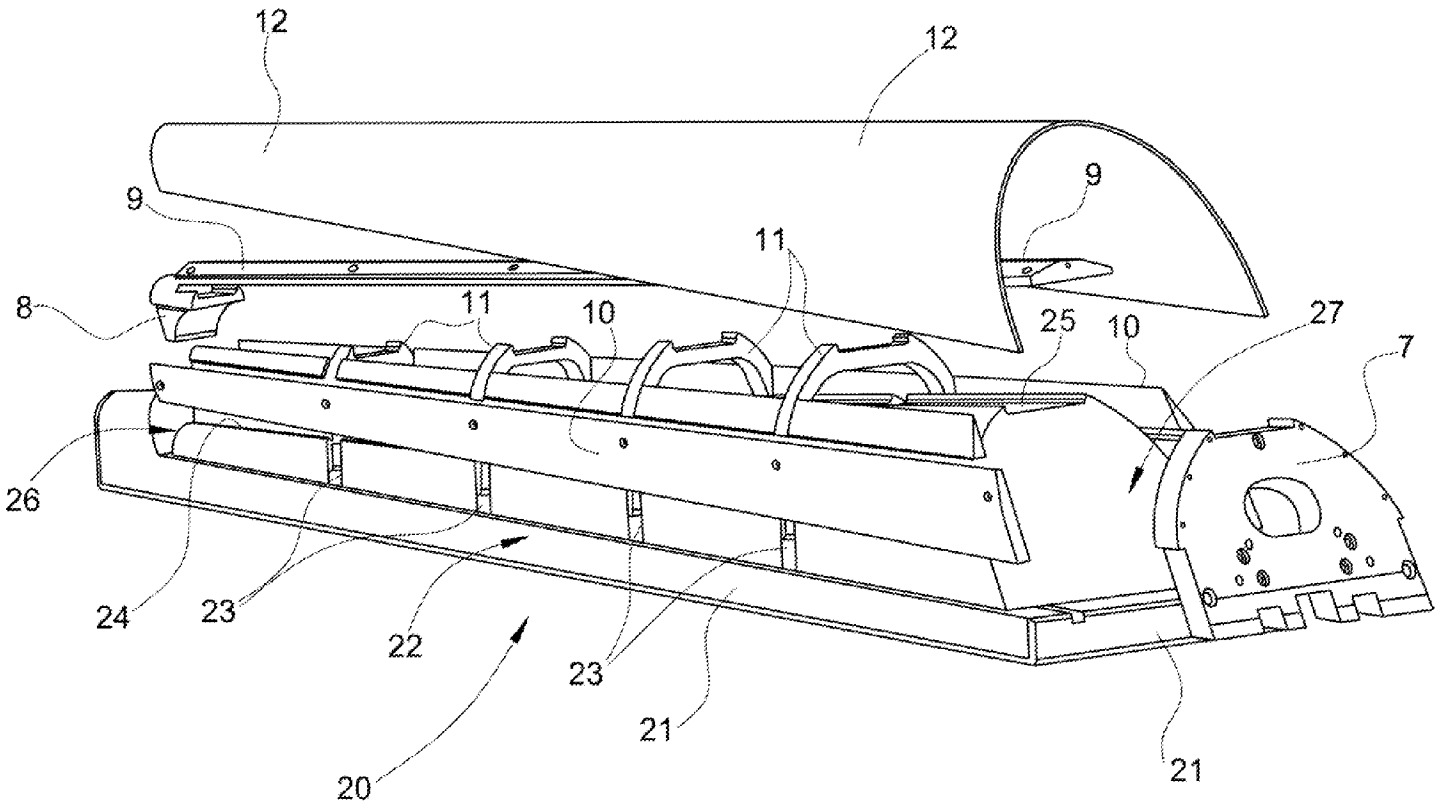
FIG. 7 is an exploded perspective view showing the template shown in FIG. 6 and various components of the sound chest.

The components can expediently be assembled by predisposing a "positive" template, such as the template designated by 20 in FIGS. 6 and 7. This template 20 has a base 21 on which there is mounted a block 22, which corresponds to the internal volume of the hollow body 6 and is provided with a series of transverse grooves 23, in which the bridges 11 are positioned precisely, with at least partial shape engagement (FIG. 7).

The ends of the block 22 are also provided with seats 26 and 27 intended to receive and position the upper block 8 and, respectively, the chest-bottom 7.

Longitudinal side receptacles 24, essentially like tracks, are also predisposed in the block 22 and are adapted to receive the side battens or planks 10 of the bearing structure; an upper longitudinal receptacle 25, likewise like a track, is also predisposed in the block 22 and is intended to receive and position the central batten or backboard 9.

Once the bridges 11 and the battens 9, 10 are positioned in the respective receptacles or seats of the block 22, the chest-bottom plate 7 and the upper block 8 can be coupled to the ends of said block 22.

All said components 7-11, positioned in the relative receptacles predisposed in the template 20, can be rapidly glued with one another and fastened using clamping screws introduced externally.

Once these operations have been carried out, the sheet(s) of maple wood 12 intended to form the shell is/are moved into contact with the various surfaces of the bearing structure, still coupled to the template 20.

This at least one bent sheet is shaped so as to "many" the shape of the underlying assembly formed by the bearing structure 9-11 and by the block 22 of the template 20, and is locked in this shape for example by wrapping it with an adhesive paper tape.

The thus loaded template 20 is then placed in a press, for example a vacuum press of the heated type, so as to give the multi-ply sheet 12 the desired curvature for the shell, and to realize the stable adhesive bonding of the various parts of the bearing structure with each other and of the shell to said bearing structure.

The hollow body thus manufactured can subsequently be separated from the template 20.

The shell body 6 thus manufactured can then be dried, without this entailing significant stress releases capable of modifying the shape of the shell, particularly since the shell 12 and the bearing structure are moulded in a single stage. The various joints between the components are optimal and do not require further significant repair operations.

The process described above is particularly advantageous in terms of repeatability, quality and economic viability.

Clearly, without departing from the principle of the invention, the embodiments and details of construction may differ considerably from those described and illustrated purely by way of non-restrictive example, without thereby departing from the scope of the invention as defined in the appended claims.

The invention claimed is:

1. A sound chest for a harp, comprising a sound board connected to a hollow body which includes a bearing structure to which there is connected an outer shell having a shape approximating half of a truncated cone, and wherein the bearing structure comprises a bottom wall or chest-bottom, and a top member or upper block, a central longitudinal batten or backboard, and two side battens or planks, which extend between the chest-bottom and the upper block, remote from and close to the sound board, respectively; and a plurality of longitudinally staggered, transverse stiffening members or bridges each of which is connected centrally to the batten or backboard and has its ends connected to the side battens or planks;

wherein the outer shell is connected to the surfaces of said battens or planks which face towards the outside;

wherein the transverse stiffening members or bridges are at least partially glued to an internal surface of said shell and wherein the portions of the bridges for coupling with the side battens or planks each have a recessed seat with an essentially L-shaped transverse profile.

2. The sound chest of claim 1, wherein the battens and the bridges have respective portions for mutual engagement, having substantially complementary transverse profiles, at least partially interpenetrated with each other.

3. The sound chest of claim 2, wherein the mutual engagement portions of the battens and the bridges are connected with each other by an adhesive interposed between the complementary profiles thereof.

4. The sound chest of claim 3, wherein the mutual engagement portions of the battens and the bridges are joined with each other through interconnection members which are inserted from the outer surface of the battens from inside the shell, and which extend through the battens and are then inserted into the bridges.

5. The sound chest of claim 1, wherein the portion of the bridges for engagement with the central batten or backboard has a recessed seat having a transverse profile shaped essentially as a squared channel.

6. The sound chest of claim 1, wherein transverse profiles of external surfaces of the bridges and the battens join with each other in a flush manner, and are connected to the internal surface of the shell with an interposed adhesive.

7. The sound chest for a harp of claim 1, wherein internal surfaces of the battens are flat.

8. A method for assembling a sound chest of the harp of claim 1, comprising the steps of positioning the chest-bottom and the upper block, the transverse stiffening members or bridges, the central batten or backboard and the side battens or planks for assembly, assembling the components positioned in the preceding step, to form the bearing structure of the sound chest, fastening to said bearing structure the outer shell, positioning a template including a block having a shape at least partially corresponding to the internal volume of the sound chest to be manufactured and having a plurality of transverse seats adapted to receive and position the upper block, a respective bridge and the chest-bottom, and a plurality of longitudinal receptacles each adapted to receive and position a respective longitudinal batten;

positioning the bridges, the upper block and the chest-bottom in the respective seats;

inserting the battens into the respective receptacles coupled with and fastened to the bridges, the upper block and the chest-bottom;

at least one flexible sheet being coupled to and fixed to the outer surface of the assembly formed by the template and the components positioned and assembled therein; and passing the loaded template in a press for a predetermined time.

* * * * *